US009060918B1

(12) United States Patent
Tomassini

(10) Patent No.: US 9,060,918 B1
(45) Date of Patent: Jun. 23, 2015

(54) ATTACHABLE MOUTHPIECE SPOUT FOR USE WITH FOOD PACKAGING

(75) Inventor: Anthony Tomassini, Laguna Niguel, CA (US)

(73) Assignee: Buon Bambini LLC, Dana Point, CA (US)

( * ) Notice: Subject to any disclaimer, the term of this patent is extended or adjusted under 35 U.S.C. 154(b) by 0 days.

(21) Appl. No.: 13/485,524

(22) Filed: May 31, 2012

Related U.S. Application Data

(60) Provisional application No. 61/491,672, filed on May 31, 2011.

(51) Int. Cl.

| | |
|---|---|
| ***B65D 25/40*** | (2006.01) |
| ***A61J 9/00*** | (2006.01) |
| *A61J 17/00* | (2006.01) |
| *A61J 11/00* | (2006.01) |

(52) U.S. Cl.

CPC ..... *A61J 9/005* (2013.01); *A61J 2017/008* (2013.01); *A61J 17/00* (2013.01); *A61J 11/001* (2013.01)

(58) Field of Classification Search

CPC ..... A61J 11/0005; A61J 11/04; A61J 11/045; A61J 15/0011; A61J 17/00; A61J 2017/006; A61J 2017/008; A61J 9/005; A61J 9/006; A61M 39/10; A61M 39/12; A61M 39/22; A61M 39/26; B65D 25/40; B65D 25/48; B65D 47/067–47/068; B65D 77/065

USPC ..... 222/564–568, 570–571, 573, 575, 547, 222/552, 555, 421, 92, 95, 96, 107, 106, 222/189.11; 215/11.1; 220/717; 606/234–235, 236

See application file for complete search history.

(56) References Cited

U.S. PATENT DOCUMENTS

| | | | | | |
|---|---|---|---|---|---|
| 165,054 | A | * | 6/1875 | Baldwin | 222/36 |
| 2,816,548 | A | * | 12/1957 | Tupper | 215/11.1 |
| 4,595,130 | A | * | 6/1986 | Berney | 222/539 |
| 5,105,985 | A | * | 4/1992 | Kroeber | 222/107 |
| 5,123,915 | A | * | 6/1992 | Miller et al. | 606/234 |
| 5,131,571 | A | * | 7/1992 | Nolley | 222/1 |
| 5,169,026 | A | * | 12/1992 | Patterson | 220/740 |
| 5,620,462 | A | * | 4/1997 | Valenti | 606/234 |
| D380,270 | S | * | 6/1997 | Rekar | D24/194 |
| 5,700,279 | A | * | 12/1997 | Blando | 606/236 |
| 6,435,177 | B1 | * | 8/2002 | Schmidt et al. | 128/200.23 |
| 7,032,764 | B2 | * | 4/2006 | Viggiano | 215/11.4 |

(Continued)

*Primary Examiner* — Frederick C Nicolas
*Assistant Examiner* — Bob Zadeh
(74) *Attorney, Agent, or Firm* — McDonnell Boehnen Hulbert & Berghoff LLP

(57) ABSTRACT

Disclosed herein are various embodiments of an attachable mouthpiece spout for use with food packaging. One example embodiment is suited for use with a food pouch that has an internal chamber for storing food, a threaded tip having a tip opening for dispensing food, and a fluid-communication path extending between the internal chamber and the tip opening. In accordance with this embodiment, the attachable mouthpiece spout includes a tube having a first end and a second end, a consumption opening disposed on the tube proximate the first end, and a thread-receiving structure disposed proximate the second end on an interior surface of the tube. The thread-receiving structure is constructed and arranged for engaging the threaded tip of the food pouch to extend the fluid-communication path to the consumption opening. In accordance with this embodiment, the attachable mouthpiece spout also includes a flared mouth guard extending from and around the tube.

14 Claims, 11 Drawing Sheets

(56) References Cited

U.S. PATENT DOCUMENTS

| | | | | |
|---|---|---|---|---|
| 7,762,427 | B2 * | 7/2010 | Sawicki | 222/1 |
| 8,336,495 | B1 * | 12/2012 | Dumm | 119/71 |
| 8,337,697 | B2 * | 12/2012 | Risheq | 210/245 |
| 8,448,820 | B2 * | 5/2013 | Johnson | 222/92 |
| 8,459,504 | B2 * | 6/2013 | Braxton et al. | 222/106 |
| 2003/0086819 | A1 * | 5/2003 | Rea | 422/28 |
| 2006/0081551 | A1 * | 4/2006 | Hegg | 215/11.1 |
| 2006/0113270 | A1 * | 6/2006 | Rea | 215/11.6 |
| 2006/0113271 | A1 * | 6/2006 | Rea | 215/11.6 |
| 2009/0001101 | A1 * | 1/2009 | Zahradka et al. | 222/228 |
| 2009/0314736 | A1 * | 12/2009 | Rigert et al. | 215/11.4 |
| 2011/0024537 | A1 * | 2/2011 | Gonzalez | 241/101.2 |

* cited by examiner

ATTACHABLE MOUTHPIECE SPOUT FOR USE WITH FOOD PACKAGING

CROSS-REFERENCE TO RELATED APPLICATIONS

This application claims priority to U.S. Provisional Patent Application Ser. No. 61/491,672, entitled "FOOD POUCH SPOUT" and filed May 31, 2011, which is hereby incorporated by reference herein in its entirety.

USAGE AND TERMINOLOGY

Throughout this application, and unless otherwise specified (or unless the particular context clearly dictates otherwise), any usage or usages of "a" or "an" are meant to be read as "at least one," any usage or usages of "the" are meant to be read as "the at least one," and the term "food" is meant to encompass food, beverage, and/or any other commonly edible substance(s).

TECHNICAL FIELD

The present application relates generally to food packaging, and more particularly to an attachable mouthpiece spout for use with food packaging that is typically used by children.

BACKGROUND

In the food-packaging industry, and particularly in the sector that relates to children's food, several food-packing products have been introduced that enhance convenience, provide portability, and generally improve the process of dispensing food, among other benefits. As shown in FIG. 1, one example is a foil food pouch 10 that includes an internal chamber 12 for storing food. Connected with the internal chamber 12 and extending from the food pouch 10 is a plastic threaded tip 14 with a tip opening 16 for dispensing food. The threaded tip 14 is hollow, and therefore the food pouch 10 includes a fluid-communication path 18 extending between the internal chamber 12 and the tip opening 16.

The fluid-communication path 18 allows food to move out of the chamber 12 and through the tip opening 16 (e.g., when a user squeezes the food pouch 10) such that the food can be dispensed into, for example, a bowl. A threaded portion 20 is disposed on an outer surface 22 of the threaded tip 14, and is configured to receive and engage a thread-receiving portion 24 disposed on an inner surface 26 of a cap 28. Due to the complementing nature of the threaded tip 14 and the cap 28, the cap 28 can be screwed onto the threaded tip to seal the food in the chamber 12 (when the food pouch 10 is being stored or transported, as a few examples).

In recent years, these sorts of food pouches have become very popular, and are currently used by many food companies throughout the world. These food pouches may contain a wide variety of food products of different types and viscosities, with a few representative examples being fruit juices, fruit and/or vegetable purees, sports drinks, dairy products, and the like. And different food pouches are often targeted towards children of different ages.

For example, because babies that are, e.g., approximately four months to one year old are typically starting to eat their first solid foods, parents and other caregivers of these children often feed them at least in part using food pouches that contain strained fruit, vegetable purees, and the like. Many parents or caregivers also seek to begin spoon-feeding children at around this age. This led to the development of a dispensing spoon 30, an example of which is also depicted in FIG. 1. Like the cap 28, a threaded portion 32 is disposed on an inner surface 34 of the spoon 30. As such, the spoon 30 can be screwed onto the threaded tip 14 of the food pouch 10. The spoon 30 also has a hollow core 36, and therefore includes a fluid-communication path 37 extending between the internal chamber 12 and an attached serving basin 38 (through the hollow core 36). When a user squeezes the food pouch 10, food is moved out of the internal chamber 12 and dispensed into the serving basin 38 for feeding to a child by a parent or other caregiver.

As another example, for toddlers and older children, food pouches are often used that have a wide variety of puree blends, fruit juices, yogurt, dairy drinks, and the like. Since these children are often considered to be old enough to feed themselves, parents and other caregivers often give these food pouches directly to children. However, rather than dispensing the food into a bowl, children often put the threaded tip straight into their mouths and then dispense and eat the food directly. This is often undesirable, as the threads on the threaded tip can cut and/or otherwise cause discomfort to the child's mouth. Indeed, these threads are often machine-added onto the threaded tip, and therefore are often made of a hard plastic and contain sharp edges. Further, children may cause damage to their teeth by chewing on the threaded tip.

Some parents and other caregivers may let children try to feed themselves by using the above-described attached dispensing spoon, but this is also often undesirable. Unlike parents or other caregivers, children are often not able (or willing) to use such a spoon in a controlled way, and therefore they often spill the food once it is squeezed out of the chamber and into the spoon's basin. As one example, children often squeeze too much food out of the chamber at one time, causing an overflow of the basin. Further, even if the basin does not overflow, children often accidentally (or purposefully) rotate the food pouch (and therefore the attached spoon) after the food has been squeezed into the basin, which again typically causes some or all of the food in the basin to spill. In addition, in the event that the spoon breaks off or is inadvertently unscrewed from the threaded tip, there is a significant risk that the child could choke on the detached spoon.

OVERVIEW

The present attachable mouthpiece spout addresses one or more of the above-identified drawbacks, among others, of the prior art, and provides several benefits over existing products.

A first embodiment of the present attachable mouthpiece spout is well suited for use with a food pouch similar to the one described above in the background section, namely one having an internal chamber for storing food, a threaded tip with a tip opening for dispensing food, and a fluid-communication path extending between the internal chamber and the tip opening. In the first embodiment, the attachable mouthpiece spout includes a tube having a first end and a second end. A consumption opening is disposed on the tube proximate the first end, and a thread-receiving structure is disposed proximate the second end on an interior surface of the tube. The thread-receiving structure is constructed and arranged for engaging the threaded tip of the food pouch to extend the fluid-communication path to the consumption opening. In the first embodiment, the attachable mouthpiece spout also includes a flared mouth guard extending from and around the tube and generally disposed on a plane defined as perpendicular to a longitudinal axis of the tube.

Various embodiments—including the herein-described first embodiment—of the present attachable mouthpiece spout have an ergonomic design that makes eating food from the food pouch easy, clean, and comfortable for a user (e.g., a child). In particular, the thread-receiving structure provides an easy way for a user to attach the attachable mouthpiece spout to the food pouch, namely by screwing it onto the threaded tip in a manner similar to that which is done with the above-described cap and attachable spoon.

Further, various embodiments—including the herein-described first embodiment—of the present attachable mouthpiece spout provide, due to the tube and the consumption opening among other aspects, provide an easy, clean, and comfortable way to dispense food to the child by allowing the child to eat the food substantially directly from the food pouch without the concern (on the part of the parent or other caregiver, and/or perhaps the child as well) that the threads of the threaded tip will be in direct contact with the child's mouth. Further, since the consumption opening is disposed proximate the first end of the tube, the child can easily put his or her mouth around the consumption opening and eat the food that is squeezed out of the chamber, while also reducing the likelihood of a spill, even if the child rotates the food pouch.

Still further, various embodiments—including the herein-described first embodiment—of the present attachable mouthpiece spout provide the benefit, among others, that the included flared mouth guard acts as a splashguard for reducing spills and the like while the child is eating, and also improves safety by significantly reducing—if not eliminating—the chance that the child could accidentally swallow the attachable mouthpiece spout should it accidentally break off or become otherwise detached (e.g., unscrewed) from the threaded tip. The mouth guard also has an ergonomic design that provides the child with a comfortable feel when the mouth guard is in physical contact with the child's mouth and the area therearound during use by the child.

As yet another benefit, the design of various embodiments—including the herein-described first embodiment—of the present attachable mouthpiece spout provides the child with a familiar feel (similar to a pacifier), which encourages the child's use and acceptance (i.e., adoption) of the attachable mouthpiece spout. However, unlike a pacifier, which lacks a fluid-communication path—and is therefore (by default and ostensibly without any thought given to any other possibility) configured to block ingress in to and egress out of the child's mouth, the attachable mouthpiece spout comprises a tube that enables the child to squeeze the food pouch and eat the food through the attachable mouthpiece spout.

The present attachable mouthpiece spout may also be configured in one or more other embodiments. For example, a second embodiment of the present attachable mouthpiece spout is well suited for use with a food package that has an internal chamber for storing food, a first securing structure with a securing-structure opening for dispensing food, and a fluid-communication path extending between the internal chamber and the securing-structure opening. In the second embodiment, the attachable mouthpiece spout includes an elongate structure having a first end and a second end, a consumption opening disposed on the elongate structure proximate the first end, and a second securing structure disposed proximate the second end. The second securing structure is constructed and arranged for engaging the first securing structure to extend the fluid-communication path to the consumption opening.

It should be understood that the above overview is provided by way of illustration and not by way of limitation, and that various embodiments of the present attachable mouthpiece spout may have none, some, or all of the above-described features and benefits.

DETAILED DESCRIPTION

Figure 1:
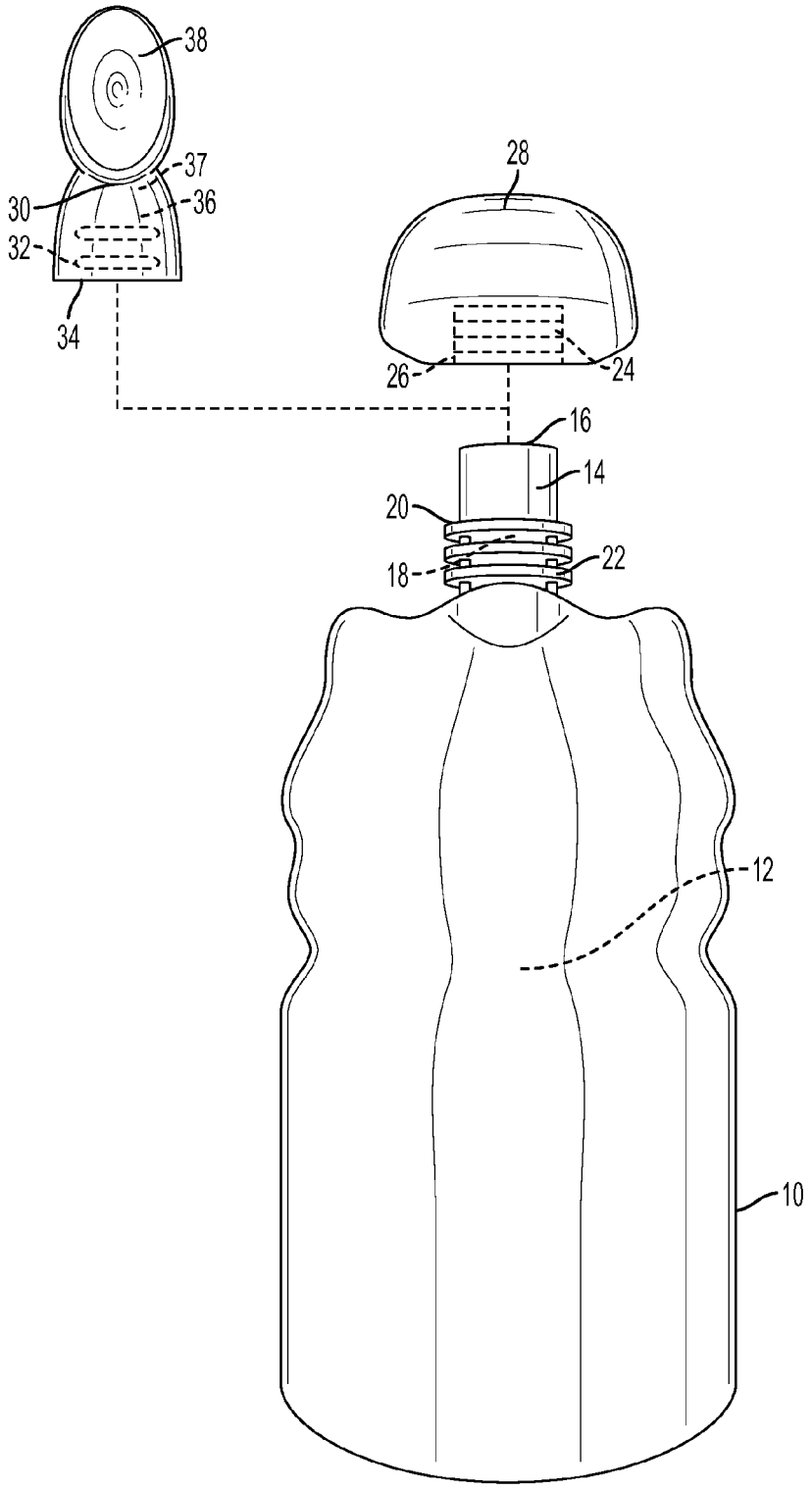
FIG. 1 (PRIOR ART)
FIG. 1 is a front perspective view of a prior art food pouch, cap, and spoon.
Figure 2:
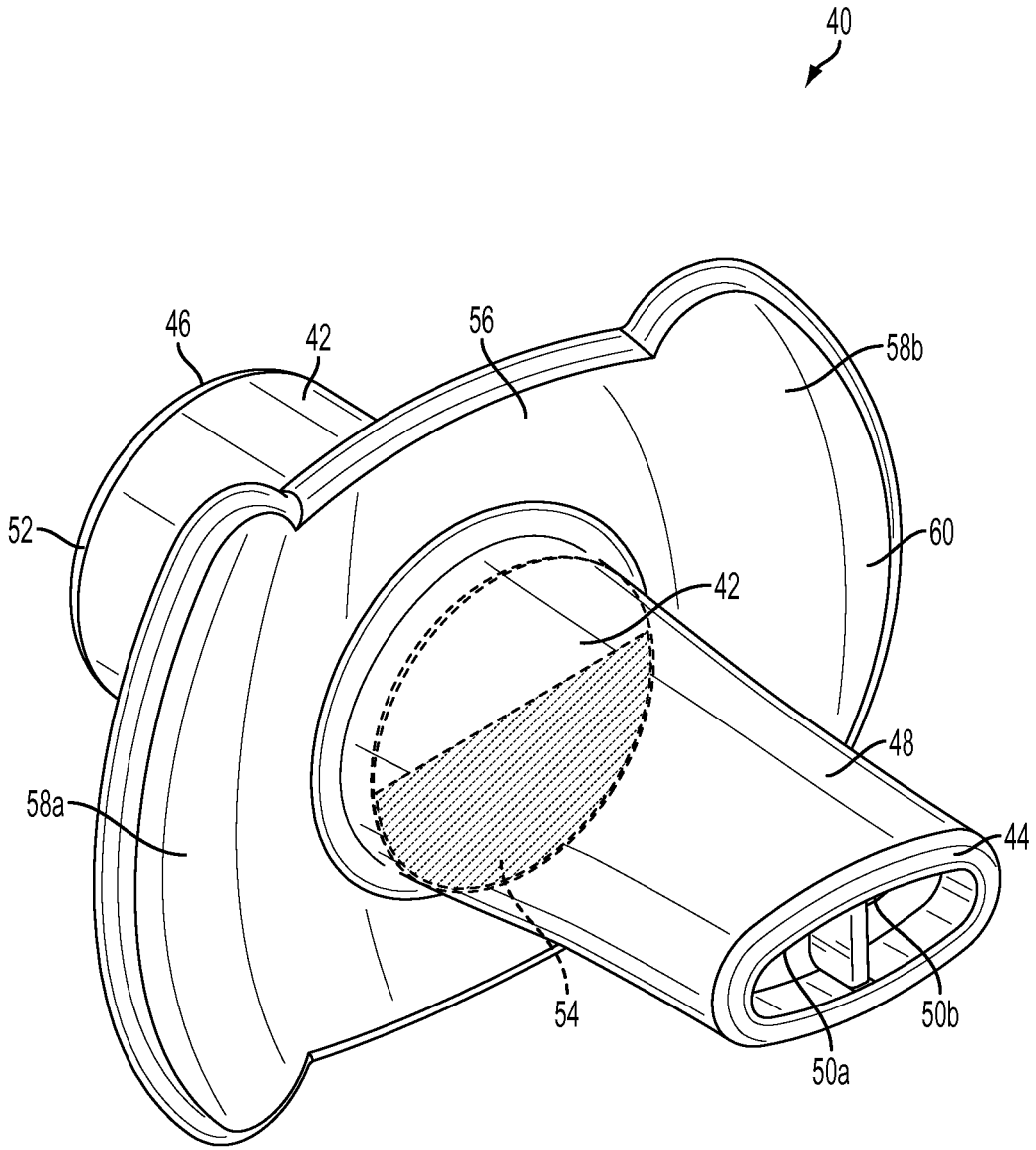
FIG. 2 is a top perspective view of a first embodiment of the present attachable mouthpiece spout.
Figure 3:
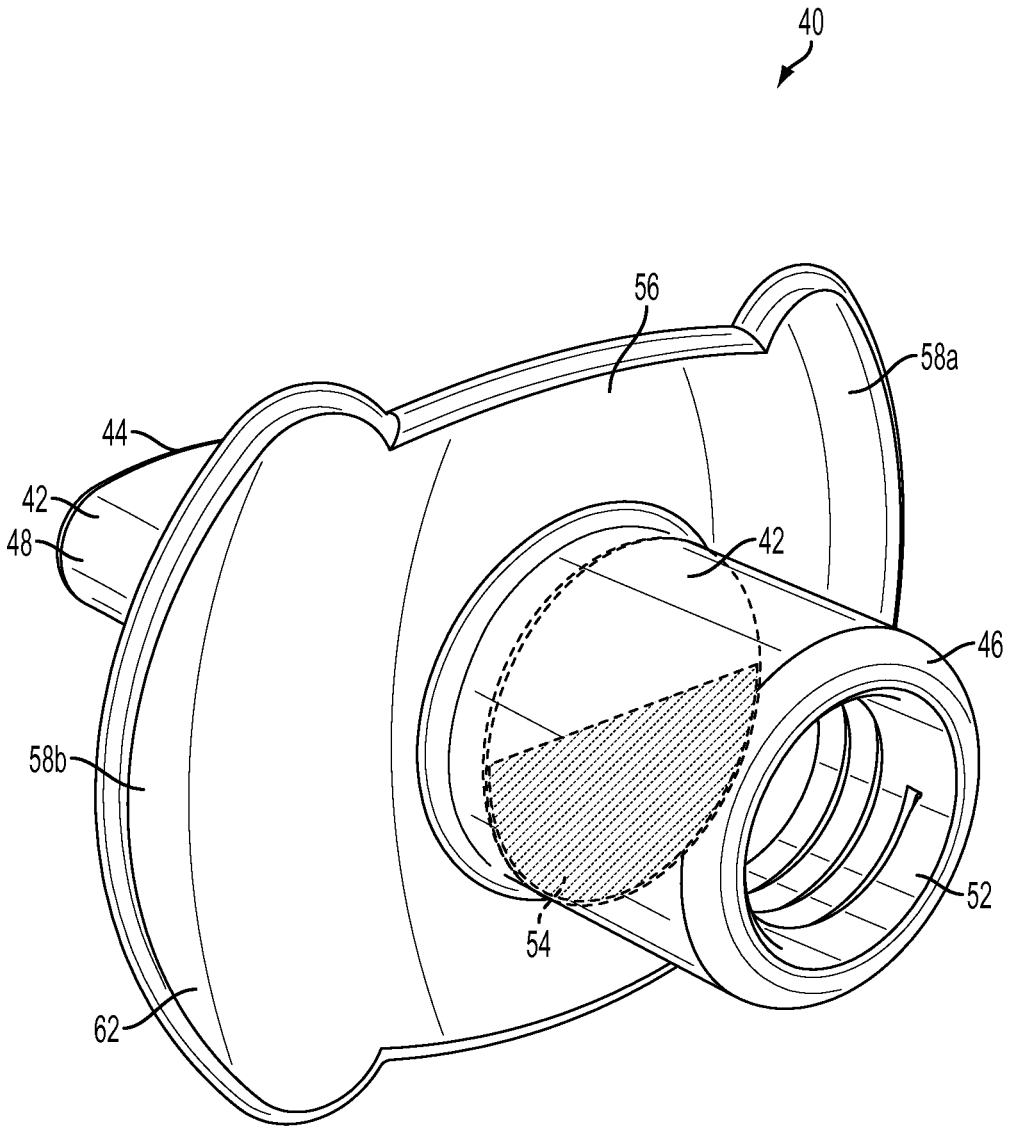
FIG. 3 is a bottom perspective view of the embodiment that is depicted in FIG. 2.
Figure 4:
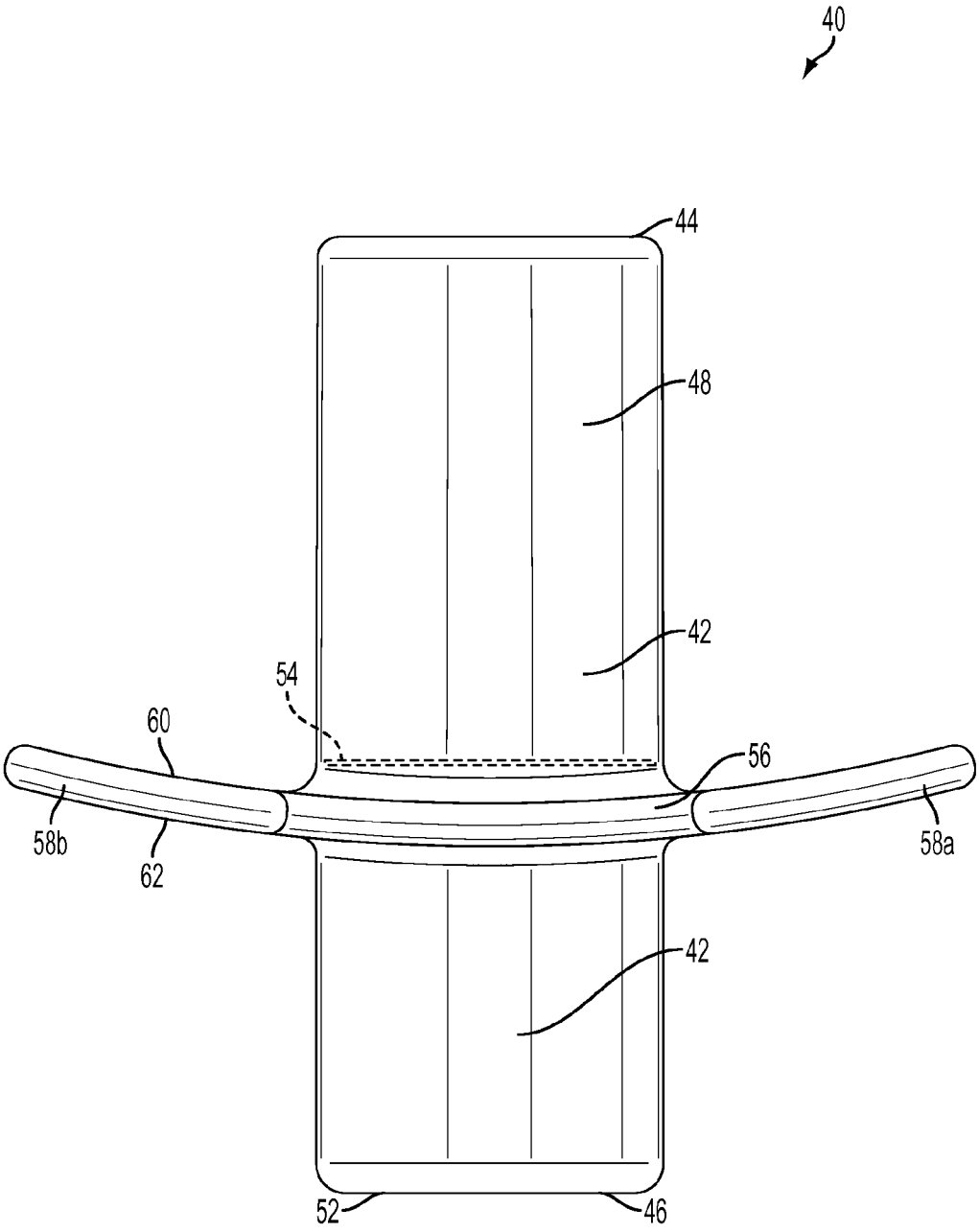
FIG. 4 is a front view (the rear view being identical) of the embodiment that is depicted in FIG. 2.
Figure 5:
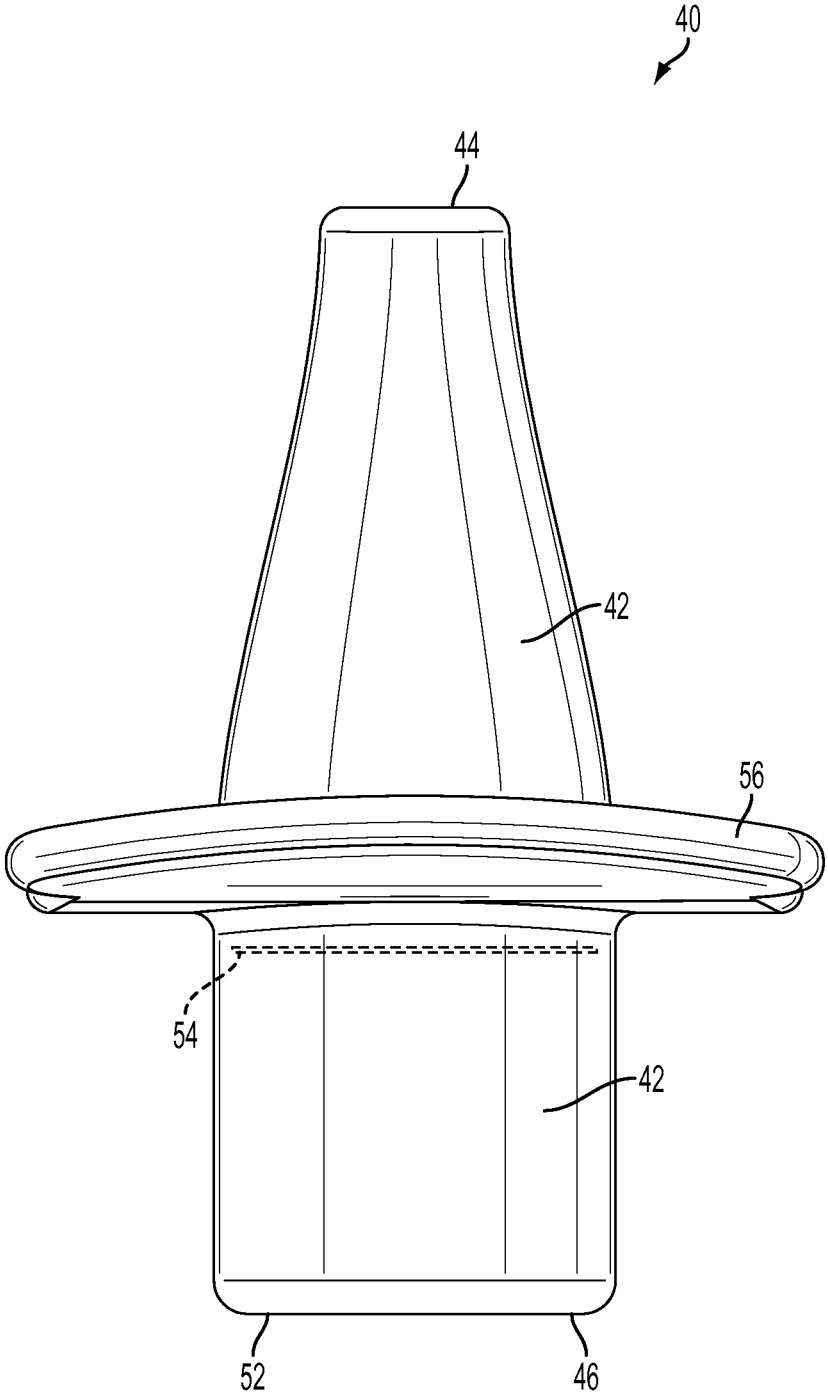
FIG. 5 is a right-side view (the left-side view being identical) of the embodiment that is depicted in FIG. 2.
Figure 6:
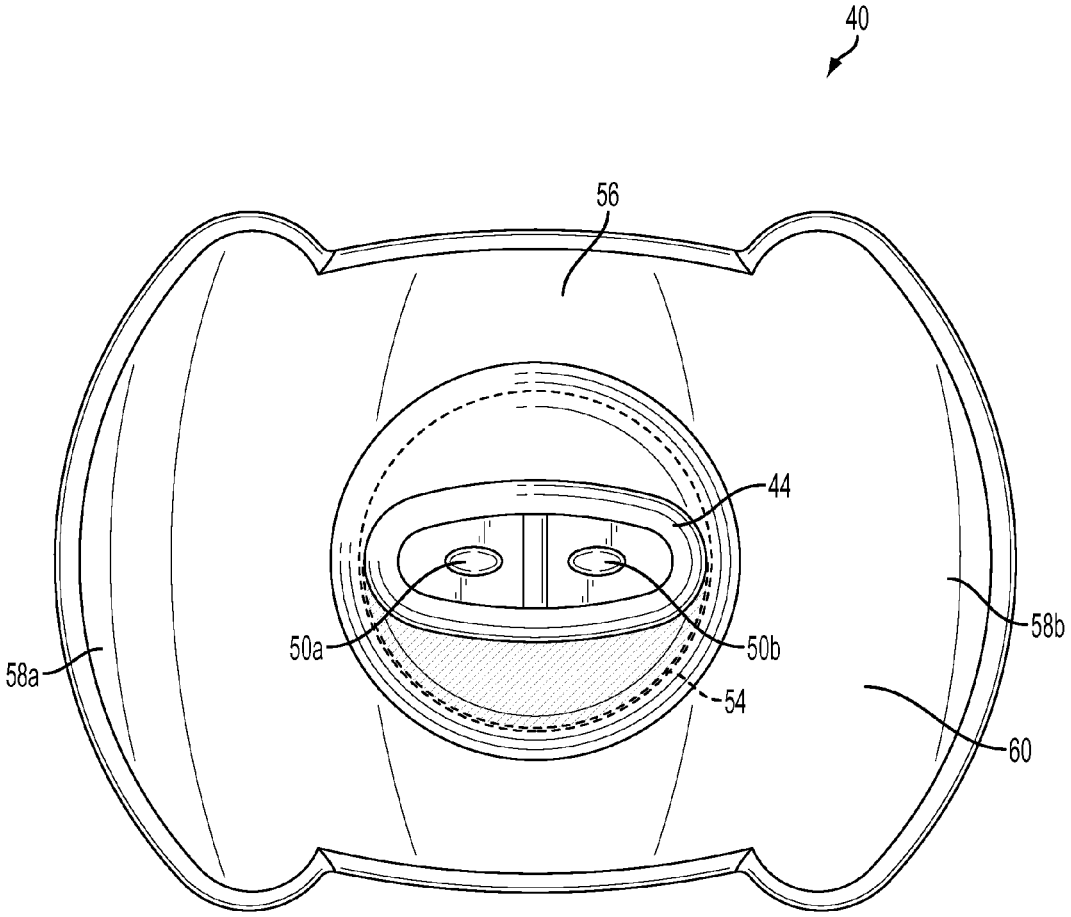
FIG. 6 is a top view of the embodiment that is depicted in FIG. 2.
Figure 7:
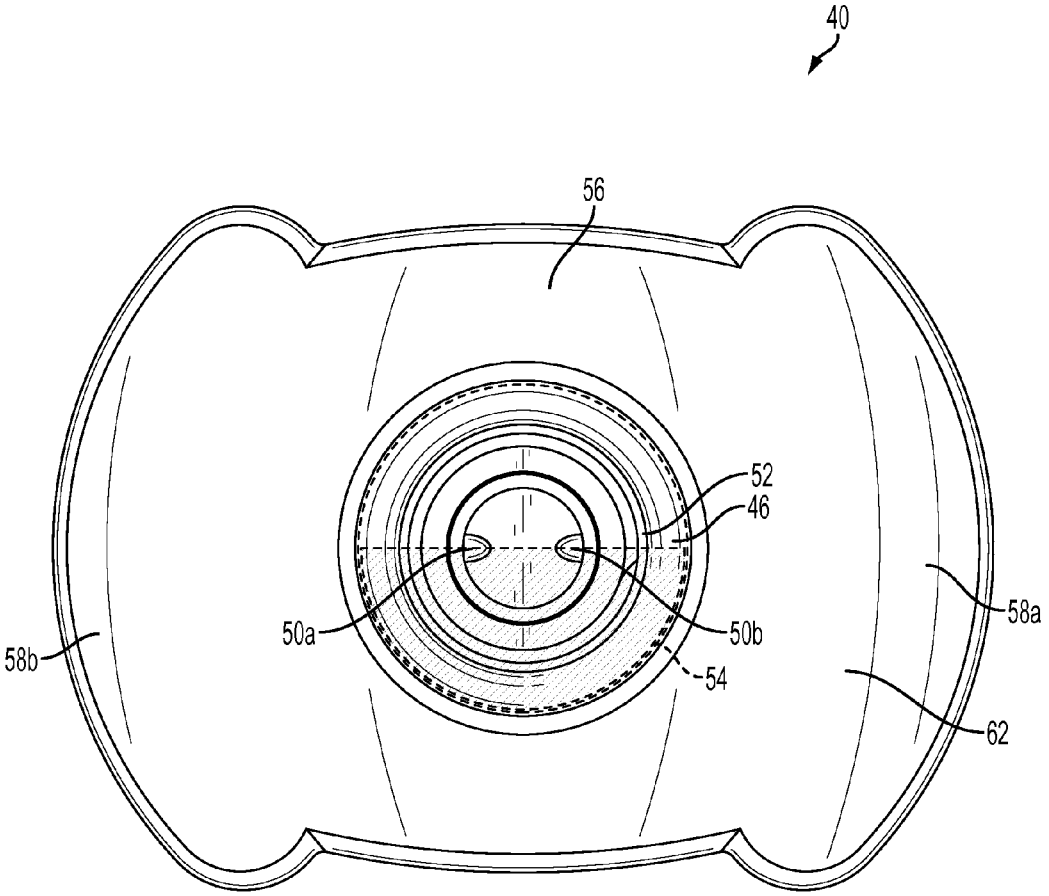
FIG. 7 is a bottom view of the embodiment that is depicted in FIG. 2.

The present attachable mouthpiece spout is well suited for use with a food package having an internal chamber for storing food, a first securing structure having a securing-structure opening for dispensing food, and a fluid-communication path extending from the internal chamber to the securing-structure opening. An example of such a food package is the food pouch shown in FIG. 1, which includes an internal chamber, a first securing structure (i.e., the threaded tip 14), and a securing-structure opening (i.e., the tip opening 16).

Referring now to FIGS. 2-8, and 10, the present attachable mouthpiece spout is shown, and is generally designated 40. Included in the attachable mouthpiece spout 40 is a hollow elongate structure 42 having a first end 44 and a second end 46. The first end 44 may be generally oval-shaped, and the elongate structure 42 may be a tube that is generally cylindrically-shaped except for a portion 48 tapering towards the first end 44. Disposed on the elongate structure 42 proximate the first end 44, is at least one, and perhaps (as depicted) two consumption openings 50*a*, 50*b*. It should be noted that other numbers of consumption openings and/or other consumption-opening configurations are contemplated and may be used (e.g., a single, slit-shaped consumption opening).

Also disposed on the elongate structure 42 proximate the second end 46 is a second securing structure 52. The second securing structure 52 is constructed and arranged for engaging the first securing structure 14 (FIG. 10) to extend the fluid-communication path 18 to the consumption opening 50. In at least one embodiment, the second securing structure 52 is a thread-receiving structure configured to receive and engage the threaded tip 14 of the food pouch 10. This feature makes it easy for a user to secure the attachable mouthpiece spout 40 to the food package 10 (e.g., by screwing the attachable mouthpiece spout on the threaded tip 14 as with the cap and spoon).

Other first and second securing-structure pairs are contemplated and could also be used (e.g., a snap-and-release clip). It should be noted that the second securing structure 52 may be configured to engage first securing structures 14 having one of a variety of shapes and sizes. For example, the second securing structure 52 may be configured to engage one or more standard sizes or gauges of a threaded tip 14. Intermediate-size adjusting structures may also be used to adapt a second securing structure 52 to a first securing structure 14 that may not otherwise provide appropriate engagement.

Further, a flow restrictor may be disposed inside the elongate structure 42 between the first end 44 and the second end 46, constructed and arranged for partially obstructing the extended fluid-communication path 18. As one example, the flow restrictor may be configured as a lower half of a generally disc-shaped structure 54 that obstructs a lower portion of the extended fluid-communication path 18, thereby only allowing a small portion of food to travel through it at a given time. This often reduces the chance that a child will dispense too much food through the attachable mouthpiece spout 40 at one time.

The elongate structure 42 and the consumption opening 50 provide an easy, clean, and comfortable way to dispense food to the child by allowing the child to eat food substantially directly from the food pouch 10, but without the concern that the threads on the threaded tip 14 (or other potentially discomforting portion of a first securing structure 14) are in direct contact with the child's mouth (i.e., due to the engagement between the first securing structure 14 and the second securing structure 52). Since the consumption opening 50 is disposed proximate the first end 44 of the attachable mouthpiece spout 40, the child has a better opportunity to engage the consumption opening and reduce the spilling food that would likely otherwise occur if the child were using a dispensing spoon. As discussed above, when using a spoon attachment, the child may easily squeeze too much food at once and cause an overflow of food in the spoon's basin. However, since the child can comfortably engage the consumption opening 50, this allows the squeezed food to be eaten directly (i.e., without being able to first overflowing a basin of the spoon). Further, use of the flow restrictor further aids in reducing the chance that the child will dispense too much food at one time and cause a spill.

Figure 8:
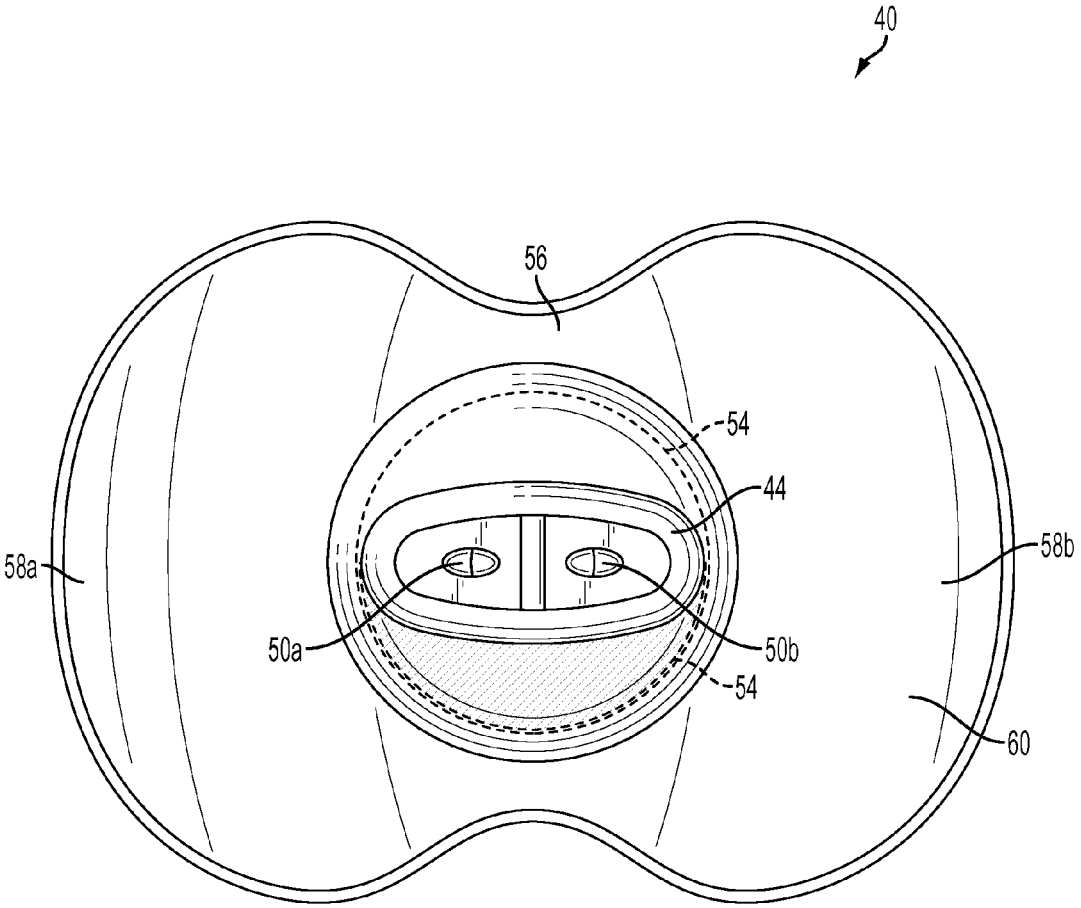
FIG. 8 is a front view of a second embodiment of the present attachable mouthpiece spout.
Figure 9:
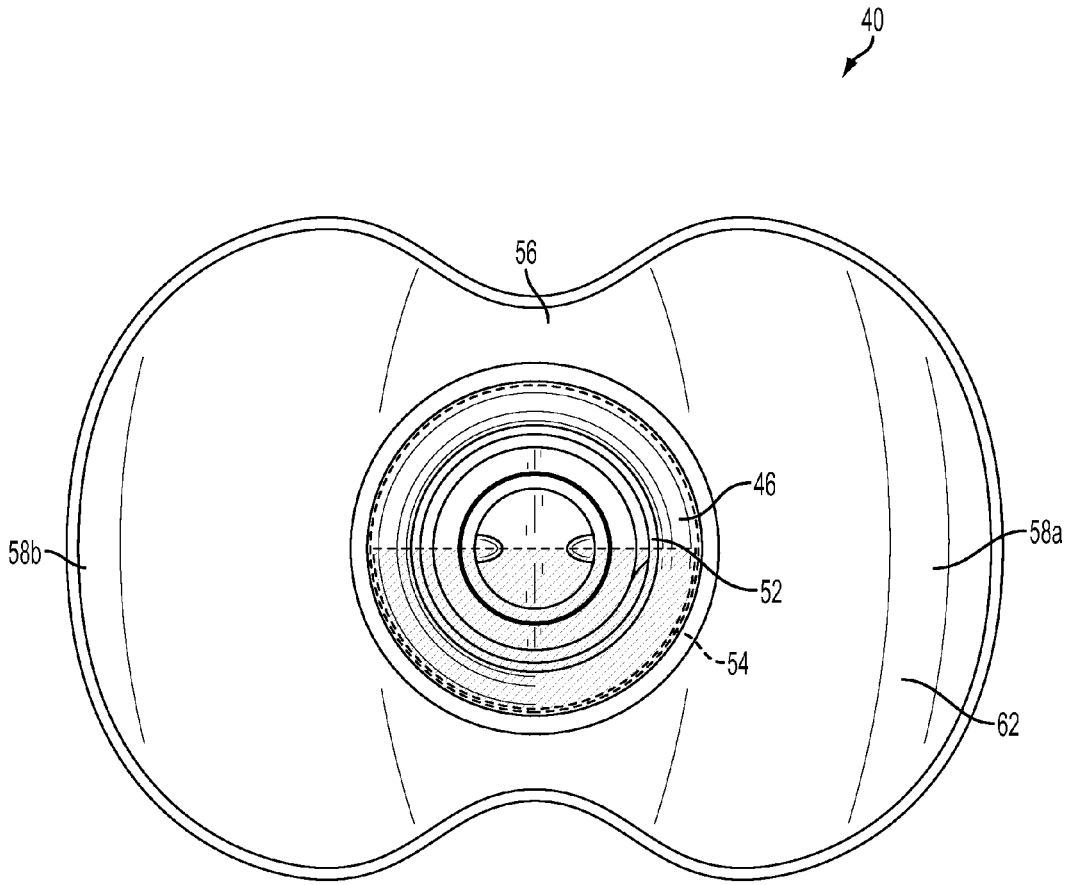
FIG. 9 is a rear view of the embodiment that is depicted in FIG. 8.
Figure 10:
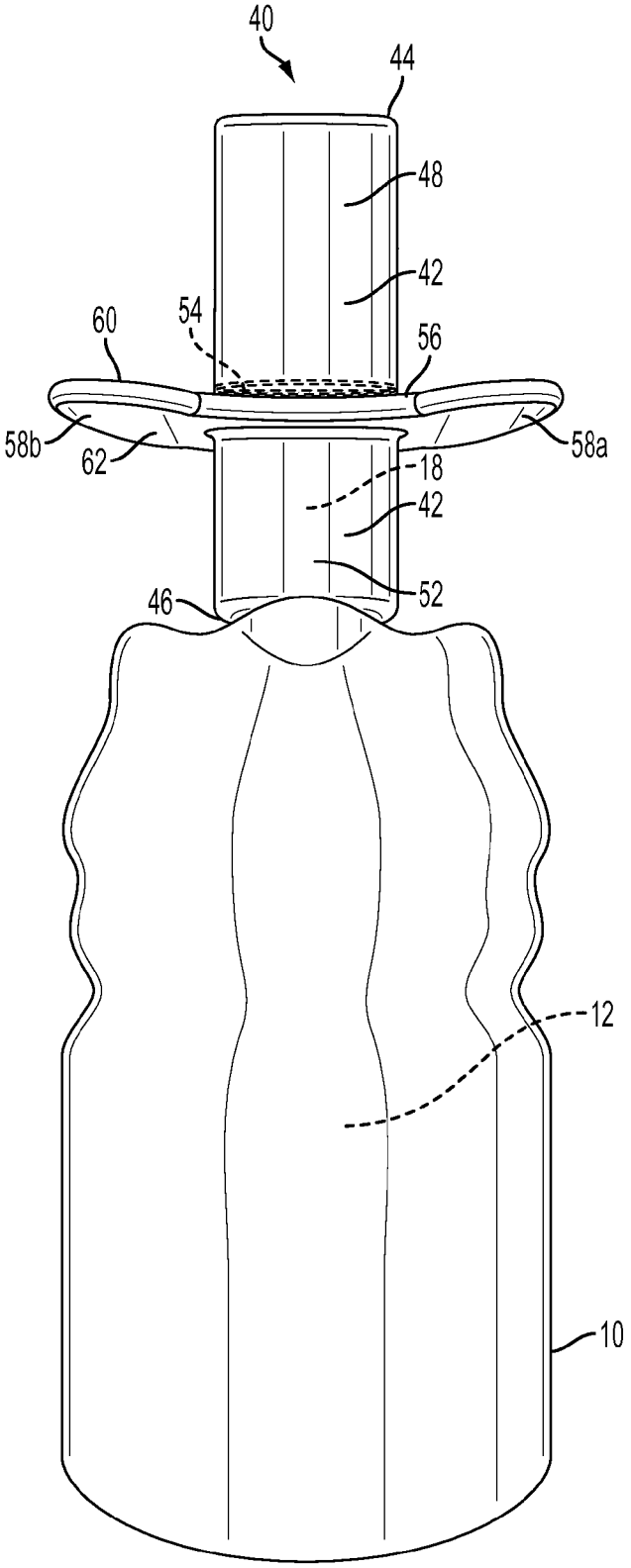
FIG. 10 is a front perspective view of a food pouch in attached engagement with the embodiment of the present attachable mouthpiece spout that is depicted in FIG. 2.

Further included on the attachable mouthpiece spout 40 is a mouth guard 56 extending from and around the elongate structure 42. Preferably, the mouth guard 56 also includes at least one, and perhaps (as depicted) two flared, arrow-shaped portions 58*a*, 58*b* each having rounded, or semi-rounded edge (similar to the configuration of a pacifier). As shown in FIGS. 8 and 9, in a second embodiment, the flared portions 58*a*, 58*b* are less pronounced, and together generally form a figure-8 shape.

Included on the mouth guard is a first surface 60 and an opposing second surface 62. The first surface 60 may be generally concave and the second surface 62 may be generally convex such that the mouth guard 56 curves towards the first end 44 and therefore, towards the mouth of a child that engages the consumption openings 50, although other configurations are also contemplated (e.g., in another embodiment, the mouth guard is generally flat). The mouth guard 56 is also generally disposed on a plane defined as perpendicular to a longitudinal axis of the elongate structure 42. Notably, reference to the plane refers to a plane tangent to an approximate center of the second surface 62 of the mouth guard 56, such that the mouth guard has a surface generally perpendicular to the elongate structure 42.

Such a configuration of the flared mouth guard portion provides at least four advantages. First, it acts as a splash-guard for reducing spills and the like while the child is eating. Second, it reduces the chance that the child will accidentally swallow the attachable mouthpiece spout 40 (due to the width of mouth guard 56 as described in greater detail below). Third, the configuration of the flared portion 58 helps provide for an ergonomic design of the entire attachable mouthpiece spout 40 that provides for an easy, smooth, and comfortable use. Fourth, the mouth guard 56 helps to provide the child with a familiar feel (similar to a pacifier), which encourages the child's use and acceptance of the attachable mouthpiece spout 40. However, unlike a pacifier, which is configured effectively in the opposite manner (i.e., as a blocking (i.e., mouth-sealing) device), the attachable mouthpiece spout 40 has a hollow core, thereby allowing the child to squeeze the food pouch and eat the food through the attachable mouthpiece spout. Notably, while the described embodiments disclose particular shapes and configurations of the mouth guard 56, the present attachable mouthpiece spout 40 is not so limited. Indeed, other structures are also considered and could be used.

In at least one embodiment, the attachable mouthpiece spout 40 is approximately 2.03 inches long (i.e., the length of the elongate structure 42), 2.00 inches wide (i.e., the width of the mouth guard 56), and 1.48 inches high (i.e., the height of the mouth guard 56), but the present spout is not limited to such specific shapes or sizes. Among other purposes and benefits, this example shape and size, and particularly this example width of the spout 40, seek to help reduce the risk that the attachable mouthpiece spout 40 would be inadvertently swallowed (e.g., if accidently broken off or unscrewed from the threaded tip 14).

Figure 11:
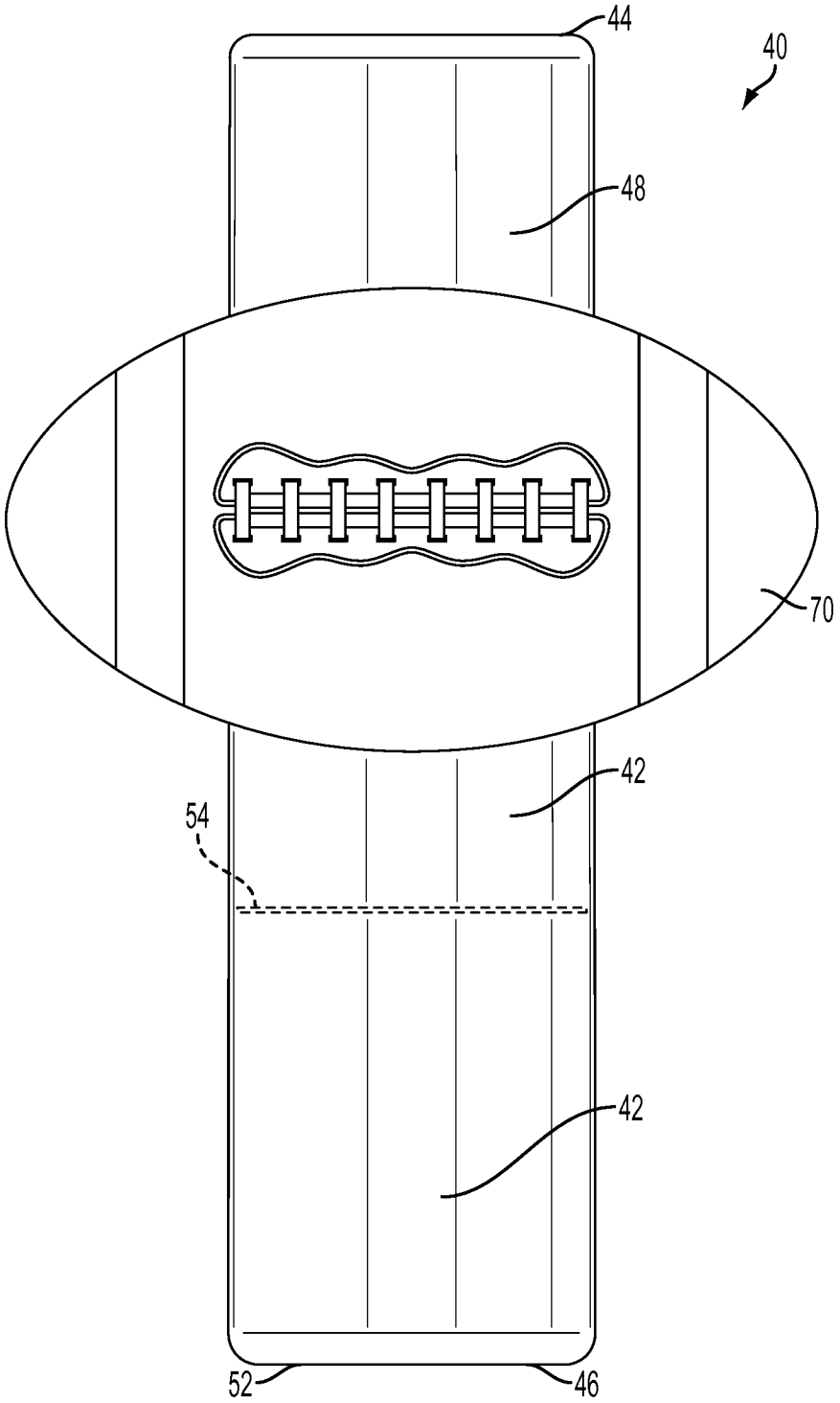
FIG. 11 is a front view of a third embodiment of the present attachable mouthpiece spout.

As shown in FIG. 11, in a third embodiment, the present attachable mouthpiece spout 40 is not configured to resemble a pacifier (i.e., it lacks the mouth guard 58), but instead it includes a blocking structure 70 extending from and around the elongate structure 48. Like the mouth guard 58, this blocking structure helps to reduce the risk that the attachable mouthpiece is accidentally swallowed (by preventing passage through the child's mouth). It is contemplated this embodiment may be preferred by older children who would likely not want to use a device that resembles a pacifier. As such, the blocking structure 70 may be designed as an object likeable to such a child (e.g., a football or a baseball). In this embodiment, it may also be preferred to extend the elongate structure 48 further than in the other described embodiments to more closely resemble a straw or another structure that is visually distinguishable from one that resembles a pacifier. As another example, the elongate structure 48 may be configured as a curly straw to further distinguish its appearance from that of a pacifier, and encourage use by the child.

The attachable mouthpiece spout 40 is preferably made from a pliable plastic material free of BPA or PVC to reduce any potential health risks associated with such materials, but other appropriate materials (preferably FDA-approved) can also be used. One likely technique for use in manufacturing the present attachable mouthpiece spout 40 is injection molding, but other techniques known to those of ordinary skill in the art are also contemplated. Preferably, the attachable mouthpiece spout 40 is formed as a single piece; however, multi-piece design pieces may also be used. For example, in one embodiment, the elongate structure 42 and the mouth guard 56 are formed as separate pieces, and are joined together using an attachment means (e.g., a bonding or snap-and-lock mechanism).

Although this document includes description of certain example embodiments, variations (i.e., changes, substitutions, alterations, and the like) of the herein-described embodiments will be apparent to those having ordinary skill in the art, where such variations do not depart from the scope of that which is set forth in the following claims. Accordingly, the inclusion in this document of the herein-described embodiments is not meant and should not be read to limit or constrain—but rather only to illustrate by example—that which is set forth in the following claims.

I claim:

1. An attachable mouthpiece spout for use with a food pouch that has an internal chamber for storing food, a threaded tip having a tip opening for dispensing food, and a fluid-communication path extending between the internal chamber and the tip opening, the attachable mouthpiece spout comprising:

a hollow tube comprising a first portion, a second portion, a first end, a second end, a continuous interior surface, and an exterior surface, wherein (i) the first portion has a shape that tapers from a generally cylindrical shape to a generally oval shape at the first end, and (ii) the second portion of the tube is generally cylindrically-shaped throughout;

a consumption opening disposed on the tube proximate the first end;

a thread-receiving structure disposed on the interior surface of the tube and proximate the second end of the tube, wherein the thread-receiving structure is constructed and arranged for engaging the threaded tip of the food pouch to extend the fluid-communication path to the consumption opening; and a flared mouth guard extending radially from a ring-shaped portion of the exterior surface of the tube, wherein the mouth guard is generally disposed on a plane defined as perpendicular to a longitudinal axis of the tube, wherein the plane defines a division between the first portion of the tube and the second portion of the tube, wherein the first portion includes a generally cylindrically-shaped first sub-portion positioned proximate the plane, wherein the second portion includes a generally cylindrically-shaped second sub-portion positioned proximate the plane, and wherein a diameter of the first sub-portion is substantially the same as a diameter of the second sub-portion.

2. The attachable mouthpiece spout of claim 1, wherein the mouth guard comprises a first surface and an opposing second surface, wherein the first surface is generally concave and the second surface is generally convex.

3. The attachable mouthpiece spout of claim 1, further comprising a flow restrictor disposed inside the tube between the first end and the second end, wherein the flow restrictor is constructed and arranged for partially obstructing the extended fluid-communication path.

4. The attachable mouthpiece spout of claim 1, wherein the consumption opening is a first consumption opening, the spout further comprising a second consumption opening disposed proximate the first end.

5. The attachable mouthpiece spout of claim 1, wherein the flared mouth guard has a width in a range from 1.8 inches to 2.4 inches.

6. The attachable mouthpiece spout of claim 1, wherein a material of the tube and the flared mouth guard is a BPA-free and a PVC-free material.

7. An attachable mouthpiece spout for use with a food package, the food package having (i) an internal chamber for storing food, (ii) a first securing structure having a securing-structure opening for dispensing food, and (iii) a fluid-communication path extending between the internal chamber and the securing-structure opening, the attachable mouthpiece spout comprising:

a hollow elongate structure having a first portion, a second portion, a first end, a second end, a continuous interior surface, and an exterior surface, wherein (i) the first portion has a shape that tapers from a generally cylindrical shape to a generally oval shape at the first end, and (ii) the second portion of the tube is generally cylindrically-shaped throughout;

a consumption opening disposed on the elongate structure proximate the first end;

a second securing structure disposed on the interior surface of the elongate structure and proximate the second end of the elongate structure, wherein the second securing structure is constructed and arranged for engaging the first securing structure to extend the fluid-communication path to the consumption opening; and a flared mouth guard extending radially from a ring-shaped portion of the exterior surface of the elongate structure, wherein the mouth guard is generally disposed on a plane defined as perpendicular to a longitudinal axis of the elongate structure, wherein the plane defines a division between the first portion of the elongate structure and the second portion of the elongate structure, wherein the first portion includes a generally cylindrically-shaped first sub-portion positioned proximate the plane, wherein the second portion includes a generally cylindrically-shaped second sub-portion positioned proximate the plane, and wherein a diameter of the first sub-portion is substantially the same as a diameter of the second sub-portion.

8. The attachable mouthpiece spout of claim 7, wherein the elongate structure is a tube.

9. The attachable mouthpiece spout of claim 7, wherein the mouth guard comprises a first surface and an opposing second surface, wherein the first surface is generally concave and the second surface is generally convex.

10. The attachable mouthpiece spout of claim 7, further comprising a flow restrictor disposed inside the elongate structure between the first end and the second end, wherein the flow restrictor is constructed and arranged for partially obstructing the extended fluid-communication path.

11. The attachable mouthpiece spout of claim 7, wherein the consumption opening is a first consumption opening, the attachable mouthpiece spout further comprising a second consumption opening disposed proximate the first end.

12. The attachable mouthpiece spout of claim 7, wherein the flared mouth guard has a width in a range from 1.8 inches to 2.4 inches.

13. The attachable mouthpiece spout of claim 7, wherein a material of the elongate structure and the flared mouth guard is a BPA-free and a PVC-free material.

14. The attachable mouthpiece spout of claim 7, wherein the first and second securing structures are constructed and arranged for releasable engagement with each other.

* * * * *